United States Patent [19]

Beldin

[11] Patent Number: 4,667,648

[45] Date of Patent: May 26, 1987

[54] VAPORIZING ASSEMBLY

[76] Inventor: Leroy E. Beldin, 3927 12th St., Moline, Ill. 61265

[21] Appl. No.: 836,042

[22] Filed: Mar. 4, 1986

[51] Int. Cl.[4] ..... F02M 29/04

[52] U.S. Cl. ..... 123/593; 48/189

[58] Field of Search ..... 123/590, 593; 48/189.6

[56] References Cited

U.S. PATENT DOCUMENTS

| | | | |
|---|---|---|---|
| 818,207 | 4/1906 | Verret et al. | 48/189.6 |
| 1,260,609 | 3/1918 | Warren | 123/593 |
| 1,506,601 | 8/1924 | Nelson | 123/593 |
| 1,542,933 | 6/1925 | Gepfert et al. | 48/189.6 |
| 1,585,403 | 5/1926 | Mayer et al. | 48/189.6 |
| 1,620,410 | 3/1927 | Tansill | 48/189.6 |
| 2,119,927 | 6/1938 | Reid | 123/593 |
| 2,657,123 | 10/1953 | Goldman | 123/593 |
| 2,701,557 | 2/1955 | Ramey | 123/593 |
| 2,899,949 | 8/1959 | Hicks | 123/593 |
| 3,088,447 | 5/1963 | Henderson | 123/593 |
| 3,449,098 | 6/1969 | Larson | 123/593 |
| 3,459,162 | 8/1969 | Burwinkle et al. | 123/593 |
| 4,020,812 | 5/1977 | Hayward | 123/593 |
| 4,091,786 | 5/1978 | Hartopp | 123/593 |
| 4,094,290 | 6/1978 | Dismuke | 123/593 |
| 4,106,454 | 8/1978 | Henlis | 123/590 |
| 4,116,183 | 9/1978 | Hayward | 123/593 |
| 4,359,035 | 11/1982 | Johnson | 123/593 |
| 4,415,507 | 11/1983 | Voliva | 123/593 |

*Primary Examiner*—E. Rollins Cross

*Attorney, Agent, or Firm*—Neuman, Williams, Anderson & Olson

[57] ABSTRACT

An assembly being interposed between a carburetor and an intake manifold comprises three spacer plates and at least two screens for vaporizing the highest concentration of fuel and for passing unobstructed the highest concentration of air traveling therethrough. The top and bottom screens are separate and parallel and extend traversely across and are substantially perpendicular to the primary passageway formed by the aligned centrally located primary passageway openings in each spacer plate. The top screen covers approximately one-half the cross-sectional area of the primary passageway opening. The bottom screen covers approximately one-third the cross-sectional area of the primary passageway opening, and both screens are situated and positioned directly below the back side of the carburetor's throttle valve.

15 Claims, 12 Drawing Figures

FIG. 1
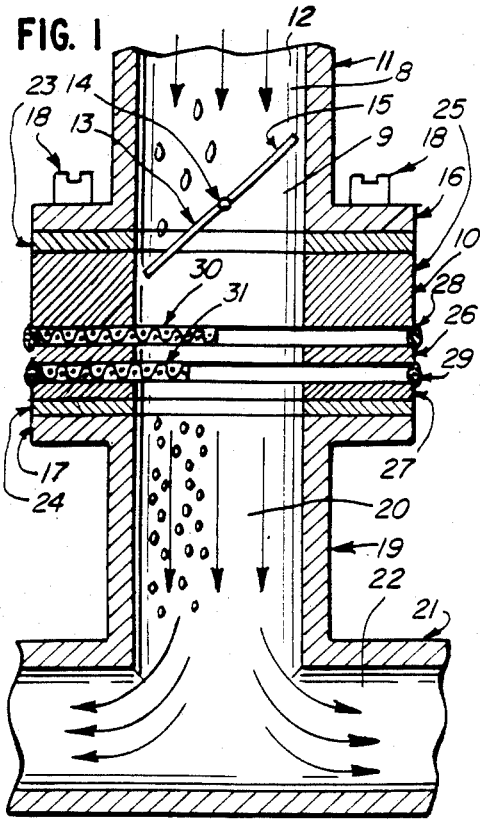
FIG. 2
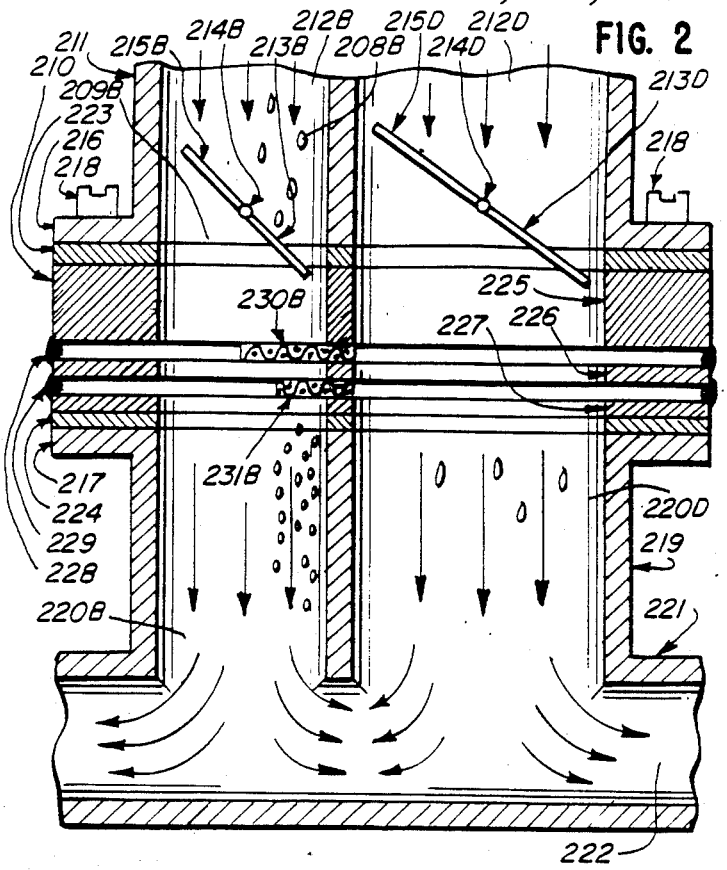
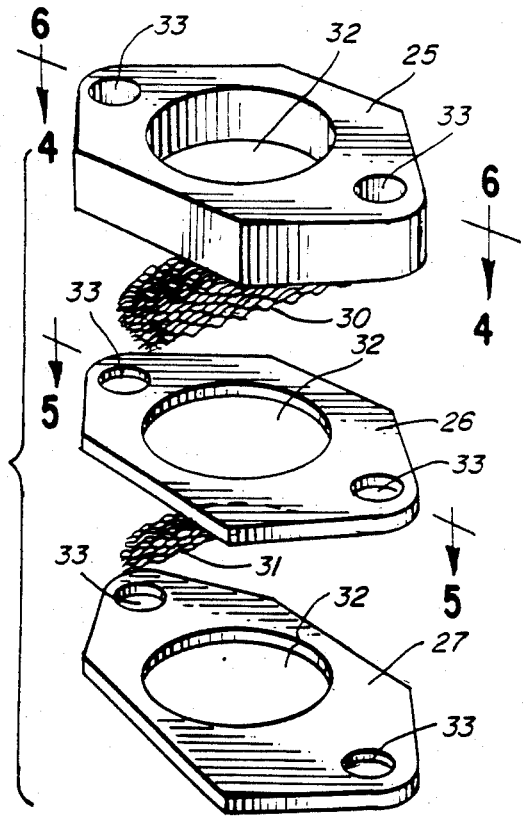
FIG. 3
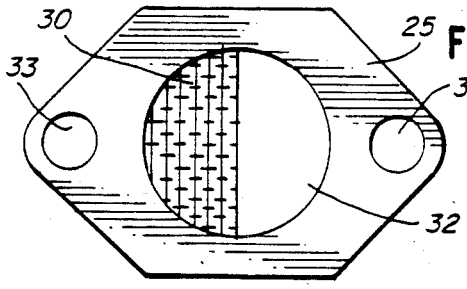
FIG. 4
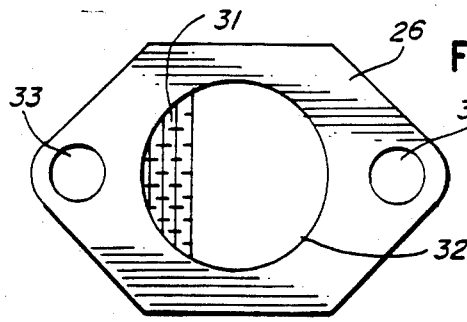
FIG. 5
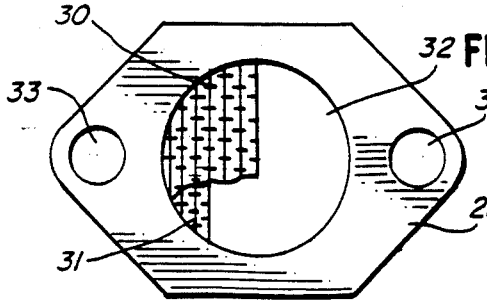
FIG. 6

VAPORIZING ASSEMBLY

BACKGROUND OF THE INVENTION

This invention relates in general to vaporization of fuel in internal combustion engines, and more particularly to an improved vaporizing assembly which can be interposed between a single-barrel or multi-barrel carburetor and the intake manifold of an internal combustion engine.

Previous attempts have been made to interpose vaporizers or atomizers between the carburetor and intake manifold. For example, some of the general, structural and operational features of the present invention are disclosed in U.S. Pat. Nos. 1,506,601, 2,119,927, 2,657,123, 2,701,557, 2,899,949, 3,088,447, 1,260,609, 3,459,162, 3,449,098, 4,020,812, 4,091,786, 4,094,290, 4,106,454, 4,116,183, 4,359,035 and 4,415,507. However, these prior art devices, while breaking up fuel for better vaporization, also tend to choke off valuable air needed to inter-mix with the fuel for proper carburetion and ideal combustion. These prior art systems also tend to ignore the varying concentrations of fuel and air within the lower throat passageway of a carburetor.

SUMMARY OF THE INVENTION

It is an object of this invention to provide a vaporizer that can more thoroughly vaporize fuel prior to its introduction into an engine, while at the same time not choke off air necessary for the proper and efficient operation of an engine.

Another object of this invention is to provide a new assembly that can be economically manufactured, readily used with present day carburetors and easily mounted between a standard carburetor and intake manifold.

Still another object of this invention is to provide a vaporizing assembly that increases power in the engine and saves fuel consumption due to a more efficient combustion.

These and other objects affected and resulting from this invention will be apparent from the following descriptions, claims and accompanying drawings.

This improved vaporizing assembly, being interposed between a carburetor and an intake manifold, comprises three steel spacer plates and at least two screens. A gasket can be placed at the top and at the bottom of the assembly. The top and bottom screens are separate and parallel and extend traversely across and are substantially perpendicular to the primary passageway formed by the aligned centrally located primary passageway openings in each spacer plate of the assembly. The top screen in the assembly covers approximately one-half the cross-sectional area of the primary passageway opening, the bottom screen covers approximately one-third the cross-sectional area of the primary passageway opening in the assembly, and both screens are situated and positioned directly below the back side of the carburetor's throttle valve. With this construction the highest concentration of fuel is more thoroughly vaporized while the highest concentration of air is passed unobstructed into the inlet passageway to the intake manifold resulting in a more complete and efficient intermixing of air and fuel for the engine.

BRIEF DESCRIPTION OF THE DRAWINGS

FIG. 1 is a schematic sectional side view of a single-barrel or double-barrel carburetor and an intake manifold having interposed between them an improved vaporizing assembly for internal combustion engines in accordance with the invention.

FIG. 2 is a schematic sectional side view of a four-barrel carburetor and an intake manifold having interposed between them another embodiment of the improved vaporizing assembly for internal combustion engines in accordance with the invention.

FIG. 3 is an exploded view of one preferred embodiment of an improved vaporizing assembly for internal combustion engines having a single-barrel carburetor in accordance with this invention.

FIG. 4 is a top view of the top spacer plate, top screen and middle spacer plate of one preferred embodiment of this invention used with a single-barrel carburetor.

FIG. 5 is a top view of the middle spacer plate, bottom screen and bottom spacer plate of one preferred embodiment of this invention used with a single-barrel carburetor.

FIG. 6 is a top view of one preferred embodiment of this invention used with a single-barrel carburetor.

DESCRIPTION OF FIRST PREFERRED EMBODIMENT

Figure 7:
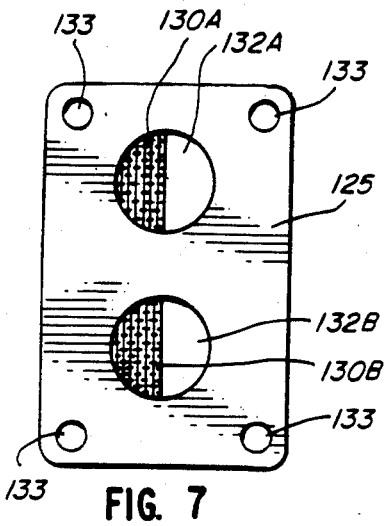
FIG. 7 is a top view of the top spacer plate, top screen and middle spacer plate of a second preferred embodiment of this invention used with a double-barrel carburetor.

FIG. 1 shows a schematic sectional view of a standard single-barrel carburetor and an intake manifold having interposed between them an improved vaporizing assembly for combustion engines in accordance with the invention. The remainder of the carburetor is not shown since it is not required for a proper understanding of the invention.

The throat of carburetor 11 is shown and has a primary passageway 12 for passing fuel and air through the carburetor and also has within its walls a throttle valve assembly 13, 14, 15. At the base of the throat of the carburetor 11 is a carburetor base flange 16 which is bolted to a complimentary manifold flange 17, the improved vaporizing assembly for combustion engines 10 being sandwiched between them. Bolts or similar fastening elements 18 are passed through the carburetor base flange 16, the improved vaporizing assembly 10, and any additional gaskets 23, 24, and into the manifold flange 17 to secure the carburetor base flange 16 and the improved vaporizing assembly 10 to the manifold flange 17.

The primary passageway 12 in the throat of the carburetor has two sections, the upper throat passageway 8 and the lower throat passageway 9, that are divided by the throttle valve assembly. The throttle valve assembly has a back side of throttle valve 13, a front side of throttle valve 15 and a throttle valve pivot 14 which allows the throttle valve to rotate from a closed (horizontal) position to an open (vertical) position.

Disposed adjacent to and beneath the lower throat passageway of the carburetor 9 and the carburetor base flange 16 is the improved vaporizing assembly 10. Disposed adjacent to and beneath the improved vaporizing assembly 10 is the manifold flange 17 and the throat of the intake manifold 19 which has an inlet passageway to the intake manifold 20 for passing fuel and air to the intake manifold 21 and its chamber 22.

The improved vaporizing assembly 10, being interposed between the throat of the carburetor 11 and the throat to the intake manifold 19, receives fuel which has been injected or sprayed into the carburetor and mixed with air, and it further heats and vaporizes the high concentration of fuel, which travels in the lower throat passageway 9 below the back side of the throttle valve 13 and through the assembly 10. Additionally, the improved vaporizing assembly does not choke off or cut off the high concentration of air which passes through the lower throat passageway of the carburetor 9 below the front side of the throttle valve 15 and through the assembly 10.

In particular, referring to FIG. 3, there is shown an exploded view of one preferred embodiment of the improved vaporizing assembly for internal combustion engines having a single-barrel carburetor.

The external shape of the assembly 10 can conform to the external contour of the manifold flange 17, carburetor base flange 16 or a standard gasket used therebetween so that there is no external leakage therefrom. Each spacer plate 25, 26, 27, has a centrally located primary passageway opening 32, that corresponds in size, cross-section and shape to the lower throat passageway of the carburetor 9 and inlet passageway to the intake manifold 20, to permit the fuel and the air to pass through the assembly 10 through the primary passageway formed by the centrally located primary passageway openings 32 that are aligned with each other and in each spacer plate 25, 26, 27. Each spacer plate 25, 26, 27, also has bolt openings 33 positioned to permit a bolt or similar fastening device 18 to pass through the carburetor base flange 16, the improved vaporizing assembly 10, and into the manifold flange 17 for securing the entire assembly 10 into its proper position.

To prevent leakage and control heat transfer, gaskets 23, 24, are preferred at both the top and the bottom of the assembly 10. The top gasket 23 and the bottom gasket 24 can be formed of heat-resistant insulating material, such as an asbestos composition.

The throttle valve assembly, disposed within the throat of the carburetor 11 and operated by the accelerator mechanism for the engine, pivots about the throttle valve pivot 14. The movement about this valve pivot 14 changes the flow of the fuel-air mixture in the primary pasageway and defines a back side of the throttle valve 13 and a front side of the throttle valve 15. Specifically, when the throttle valve assembly is pivoted about the throttle valve pivot 14, it rotates from its closed (horizontal) position to its opened (vertical) position, one side of the throttle valve tends to move in an upward direction away from the inlet passageway to the intake manifold 20, the front side of the throttle valve 15, and the other side of the throttle valve, the back side of the throttle valve 13, tends to move in a downward direction towards the inlet passageway to the intake manifold 20.

To prevent the back side of the throttle valve 13 from coming in contact with the top screen 30 and to assure unobstructed movement of the throttle valve assembly 13, 14, 15, a top spacer plate 25 is provided which is preferably positioned below the top gasket 23. The top spacer plate 25 forms part of the housing for the top screen 30 and is preferably made of metal such as steel. The thickness of this plate 25 can vary depending on the size of the throttle valve assembly 13, 14, 15, or the length of the back side of the throttle valve 13, the thickness of the top gasket 23 or the requirements of the system and the desired results.

Interposed between the top screen 30 and the bottom screen 31 is the middle spacer plate 26 which separates the screens and forms part of the housing for each screen. Preferably this middle spacer plate 26 is made of metal such as steel and has a thickness between $\frac{1}{8}''$ and $1/16''$.

Interposed between the bottom screen 31 and the bottom gasket 24 is the bottom spacer plate 27 which forms part of the housing for the bottom screen 31. Preferably this bottom spacer plate 27 is also made of metal such as steel and has a thickness between $\frac{1}{8}''$ and $1/16''$.

The top screen 30, housed between the top spacer 25 plate and the middle spacer plate 26, can be attached directly to either or both of these plates. The bottom screen 31 is housed between the middle spacer plate 26 and the bottom spacer plate 31 and can also be attached directly to either or both of the plates. For example, one method of attaching and enclosing the screens is to position the screens between the plates and weld the top screen 30 to the top spacer plate 25 and to the middle spacer plate 26 at their externally exposed surface by continuous weld 28 and weld the bottom screen 31 to the middle spacer plate 26 and to the bottom spacer plate 27 at their externally exposed surface by continuous weld 29.

It has been found that sealing the assembly from the surrounding atmosphere is essential for its efficient operation. Thus, the spacer plates 25, 26, 27, should be welded together by continous welds 28, 29, preferably at their externally exposed surface, in a manner so as to prevent air or fuel from escaping or entering the assembly between the plates and to maintain a vacuum within the assembly.

Each enclosed screen's mesh or grid is approximately parallel to each other and to the spacer plates 25, 26, 27, and perpendicular to the primary passageway formed by the aligned centrally located primary passageway openings 32 in each spacer plate 25, 26, 27, in the assembly 10. In the preferred construction it has been found that stainless steel and tungsten are suitable materials for the screens. Moreover, the screens can have varied mesh sizes depending on the requirements and desired efficiency of the system, but it is preferable that a mesh size of about 30 holes to the inch be used.

The highest concentration of fuel exists below the back side of throttle valve 13 in the lower throat passageway of the carburetor 9 and the highest concentration of air exists below the front side of throttle valve 15 in the lower throat passageway 9, because fuel is typically injected or sprayed into the upper throat passageway 9 of the carburetor above the back side of the throttle valve 13. The screens are positioned so as to further vaporize the highest concentration of fuel passing through the assembly and to pass without obstruction the highest concentration of air through the assembly. Thus, the more thoroughly vaporized fuel and the unchoked air may more completely and efficiently be mixed.

FIGS. 4, 5 and 6 specifically show the best contemplated mode for orienting the two screens 30, 31, within the assembly designed for a single-barrel carburetor. In particular, FIG. 4 shows the top screen 30 is oriented so as to bisect the primary passageway formed by the aligned centrally located primary passageway openings 32 in each spacer plate 25, 26, 27. It extends into approximately one-half of the primary passageway formed by the aligned centrally located primary passageway openings 32 in each spacer plate 25, 26, 27, leaving about one-half of the primary passageway unscreened. Approximately one-half of the cross-sectional area of the primary passageway formed by the aligned centrally located primary passageway openings 32 in each spacer plate 25, 26, 27, is covered by the top screen 30. In particular, the top screen 30 is situated directly beneath the back side of the throttle valve 13 so that it covers the cross-sectional area of the primary passageway formed by the aligned centrally located primary passageway openings 32 in each spacer plate 25, 26, 27, directly below the back side of the throttle valve 13.

In FIG. 5, it is shown that the bottom screen 31, situated below the top screen 30, is also beneath the back side of the throttle valve 13. The bottom screen 31 covers less area than the top screen 30. The bottom screen 31 is oriented so as to intersect and cover approximately one-third of the cross-sectional area of the primary passageway formed by the aligned centrally located primary passageway openings 32 in each spacer plate 25, 26, 27, leaving about two-thirds of the cross-sectional area of the primary passageway unscreened. Additionally, as shown in FIG. 6, it is preferable to orient the screens so that when viewing the primary passageway formed by the aligned centrally located primary passageway openings 32 in each spacer plate 25, 26, 27, from above the assembly, the mesh of the bottom screen 31 is offset from the mesh of the top screen 30. As a result of having the metal part of the screens staggered, the system is more efficient in vaporizing the fuel passing therethrough in its highest concentration. Using 30 holes to the mesh screens and orienting the screens in this staggered or offset manner permits approximately one-half of the primary passageway formed by the aligned centrally located primary passageway openings 32 in each spacer plate 25, 26, 27, the section directly below the front side of the throttle valve and passing the highest concentration of air, to be free of any screens; approximately one-sixth of the cross-sectional area of the primary passageway formed by the aligned centrally located primary passageway openings 32 in each spacer plate 25, 26, 27, to be covered with 30 holes to the inch screening, the mesh of the top screen 30; and approximately one-third of the cross-sectional area of the primary passageway formed by the aligned centrally located primary passageway openings 32 in each spacer plate 25, 26, 27, to be covered with approximately 120 holes to the inch screening, the combined mesh of the separated top screen 30 and bottom screen 31.

Thus, with this improved vaporizing assembly 10, the highest concentration of fuel introduced into the assembly from the lower throat passageway of the carburetor and below the back side of the throttle valve is more thoroughly vaporized as it passes through the assembly's two screens 30, 31. The highest concentration of air is not choked off or obstructed as it passes through the assembly.

DESCRIPTION OF SECOND PREFERRED EMBODIMENT

Figure 8:
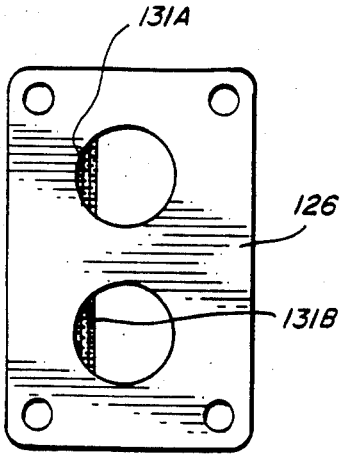
FIG. 8 is a top view of the middle spacer plate, bottom screen and bottom spacer plate of a second preferred embodiment of this invention used with a double-barrel carburetor.
Figure 9:
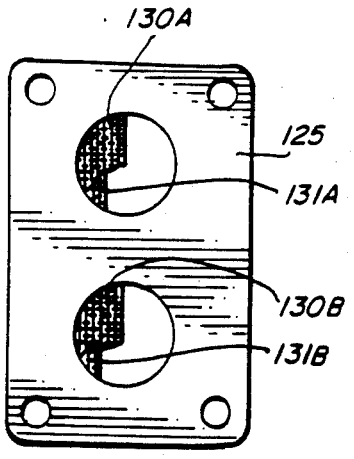
FIG. 9 is a top view of a second preferred embodiment of this invention used with a double-barrel carburetor.

The assembly shown in FIGS. 1, 3, 4, 5 and 6 is one preferred embodiment used with a standard single-barrel carburetor. However, the present invention can be modified to be easily used with and incorporated in systems having multiple-barrel carburetors. For example, FIGS. 7, 8 and 9 show a second embodiment of this improved vaporizing assembly for use with a dual or two-barrel carburetor having two primary passageways for fuel and air in the carburetor. A carburetor of this type is like a cluster of two single-barrel carburetors and would be similar to the one shown in FIG. 1, with a similar second primary passageway directly behind and parallel to the first primary passageway 12 shown in FIG. 1. For convenience, similar reference numerals in the 100 series are used in FIGS. 7, 8 and 9 as those used in FIGS. 4, 5 and 6.

As in the assembly for use with a single-barrel carburetor, a top spacer plate 125, a middle spacer plate 126 and a bottom spacer plate 127 are provided. The construction, material, positioning, functioning, orientation, and shape of these spacer plates can be similar to those used in the assembly for the single-barrel carburetor taking into consideration the different shape and size of the throat of the carburetor, the carburetor base flange, the two primary passageways, the manifold flange and the inlet passageways to intake manifold. Each spacer plate has two primary passageway openings 132A, 132B, that correspond in size and shape to both lower throat passageways of the carburetor and the inlet passageways to the intake manifold to permit the fuel and the air to pass through the assembly 110 through the primary passageways formed by the primary passageway openings 132A, 132B, that are aligned with each other and in each spacer plate 125, 126, 127. Each spacer plate has bolt openings 133 to permit a bolt or similar fastening device to pass through the assembly and to secure it between the carburetor base flange and the manifold flange. To prevent leakage and control heat transfer, gaskets are preferred at both the top and the bottom of the assembly. Moreover, the assembly can be interconnected in a manner similar to the assembly described for a single-barrel carburetor.

The screens are enclosed and the plane of each screen's mesh or grid is approximately parallel to the plane of the mesh of the screen above or below it and to the spacer plates and perpendicular to the primary passageway it partially covers which is formed by the aligned primary passageway openings 132A, 132B, in each spacer plate 125, 126, 127. FIG. 7 shows the top screens 130A, 130B, are oriented so as to bisect each primary passageway formed by the aligned primary passageway openings 132A, 132B, in each spacer plate 125, 126, 127. Each top screen 130A, 130B, covers approximately one-half of the cross-sectional area of each primary passageway formed by the aligned primary passageway openings 132A, 132B, in each spacer plate 125, 126, 127. Additionally, each top screen 130A, 130B, is situated directly beneath the back side of the throttle valve in the primary passageway so that it covers the cross-sectional area of the primary passageway formed by the aligned primary passageway openings 132A, 132B, in each spacer plate 125, 126, 127, directly below the back side of the throttle valve.

In FIG. 8, it is shown that the bottom screens 131A, 131B, situated below the top screens 130A, 130B, are also beneath the back side of the throttle valve in each primary passageway. Each bottom screen 131A, 131B, intersects and covers less area than each of the top screens 130A, 130B, and each bottom screen 131A, 131B, preferably covers approximately one-third of the cross-sectional area of each primary passageway formed by the aligned primary passageway openings 132A, 132B, in each spacer plate 125, 126, 127, leaving about two-thirds of the cross-sectional area of each primary passageway unscreened. Also, it is understood that the bottom screens 131A, 131B, for this second preferred embodiment do not necessarily have to be two separate screens but can be a single large screen and the top screens 130A, 130B, can be a single large screen.

As shown in FIG. 9, it is preferable to orient the screens so that when viewing the primary passageways formed by the aligned primary passageway openings 132A, 132B, in each spacer plate 125, 126, 127, from above the assembly, the mesh of the bottom screens 131A, 131B, is offset from the mesh of the top screens 130A, 130B. As a result of having the metal part of the screens staggered, the system is more efficient in vaporizing the fuel passing therethrough in its highest concentration. Using 30 holes to the inch screen is also preferable.

DESCRIPTION OF THIRD PREFERRED EMBODIMENT

The present invention can be modified to be used with and incorporated in systems having carburetors for internal combustion engines with more than two-barrels. In such systems, the assembly can be constructed similarly and according to the two embodiments previously described, however, the screens only partially cover the primary passageways in the assembly and do not cover the secondary passageways in the assembly.

FIGS. 2, 10, 11 and 12 show a third embodiment of the improved vaporizing assembly to be used with a standard four-barrel carburetor. For convenience, and whenever possible, similar reference numerals in the 200 series are used in FIGS. 2, 10, 11 and 12 as those used in FIGS. 1, 4, 5 and 6.

FIG. 2 shows a schematic sectional view of a standard four-barrel carburetor and an intake manifold having interposed between them an improved vaporizing assembly for combustion engines having a four-barrel carburetor in accordance with the invention. The throat of a four-barrel carburetor typically has two primary passageways for passing fuel and air, and two secondary passageways for passing additional fuel and air when the engine operates at high speeds or when additional power is needed. FIG. 2 shows the sectional view of one primary passageway 212B and the sectional view of one secondary passageway 212D. A second parallel and similar primary passageway is behind the primary passageway 212B shown, and a second parallel and similar secondary passageway is behind the secondary passageway 212D shown.

A throttle valve assembly is located in each of the four passageways. The throat of the carburetor 211 also has a carburetor base flange 216 which is bolted to a complimentary manifold flange 217. The improved vaporizing assembly for combustion engines 210 is sandwiched between them. Bolts or similar fastening elements 218 are passed through the carburetor base flange 216, the improved vaporizing assembly 210 and any additional gaskets 223, 224, and into the manifold flange 217 to secure the carburetor base flange 216 and the improved vaporizing assembly 210 to the manifold flange 217. Each primary passageway in the throat of the carburetor 212B has two sections, the upper throat passageway 208B and the lower throat passageway 209B, that are divided by the throttle valve assembly 213B, 214B, 215B.

Each throttle valve in the primary passageways of the carburetor has a back side of throttle valve 213B which tends to move in a downward direction when the throttle valve is opened, a front side of throttle valve 215B which tends to move in an upward direction when the throttle valve is opened and a throttle valve pivot 214B which allows the throttle valve to rotate from a closed (horizontal) position to an open (vertical) position.

The external shape of the third embodiment of the assembly can also conform to the external contour of the manifold flange 217, carburetor base flange 216, or standard gasket used therebetween so that there is no external leakage therefrom. Each spacer plate 225, 226, 227, has two primary passageway openings 232A, 232B, and two secondary passageway openings 232C, 232D, that correspond in size, cross-section and shape to the lower throat passageways of the carburetor and the inlet passageways to the intake manifold, to permit the fuel and air to pass through the assembly 210 through the primary and secondary passageways formed by the primary and secondary passageway openings 232A, 232B, 232C, 232D, that are aligned with each other and in each spacer plate 225, 226, 227. Each spacer plate 225, 226, 227, also has bolt openings 233 positioned to permit a bolt or similar fastening device 218 to pass through the carburetor base flange 216, the improved vaporizing assembly 210, and into the manifold flange 217 for securing the entire assembly 210 into its proper position.

Gaskets 223, 224, of heat-resistant insulating material, such as an asbestos composition, are preferred at both the top and the bottom of the assembly 210.

To prevent the back side of each throttle valve 213B in a primary passageway from coming in contact with a top primary passageway screen 230A, 230B, a top spacer plate 225 is provided which is positioned below the top gasket 223. The top spacer plate 225 forms part of the housing for the top primary passageways screens 230A, 230B, and is preferably made of metal such as steel. The thickness of this plate 225 can vary depending on the size of the throttle valve assembly, or the length of the back side of the throttle valve 213B, the thickness of the top gasket 223, or the requirements of the system and the desired results.

Interposed between the top primary passageway screens 230A, 230B, and the bottom primary passageway screens 231A, 231B, is the middle spacer plate 226 which separates the top and bottom screens and forms part of the housing for each screen. Preferably this middle spacer plate 226 is made of metal such as steel and has a thickness between $\frac{1}{8}''$ and 1/16".

Interposed between the bottom primary passageway screens 231A, 231B, and the bottom gasket 224 is the bottom spacer plate 227 which forms part of the housing for the bottom primary passageway screen 231A, 231B. Preferably this bottom spacer plate is also made of metal such as steel and has a thickness between ⅛" and 1/16".

Each top primary passageway screen 230A, 230B, and each bottom primary passageway screen 231A, 231B, can be attached to both of the plates it is in contact with.

Again, it has been found that sealing the assembly from the surrounding atmosphere is essential for its efficient operation. Thus, the spacer plates 225, 226, 227, should be welded together by continuous welds 228, 229, preferably at their externally exposed surface, in a manner so as to prevent air or fuel from escaping or entering the assembly between the plates and to maintain a vacuum within the assembly.

The primary passageway screens are enclosed and the plane of each screen's mesh or grid is approximately parallel to the plane of the mesh of the screen above or below it and to the spacer plates 225, 226, 227, and perpendicular to the primary passageway formed by the aligned primary passageway openings 232A, 232B, in each spacer plate 225, 226, 227. Stainless steel and tungsten are suitable materials for the screens. Moreover, the screens can have varied mesh sizes depending on the requirements and desired efficiency of the system, but it is preferable that a mesh size of about 30 holes to the inch be used.

Figure 10:
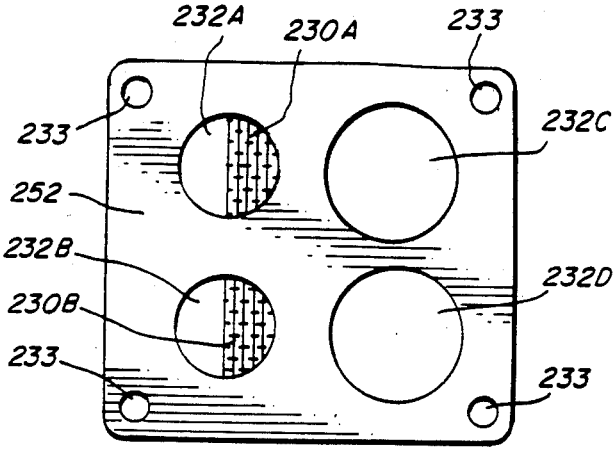
FIG. 10 is a top view of the top spacer plate, top screen and middle spacer plate of a third preferred embodiment of this invention used with a four-barrel carburetor.
Figure 11:
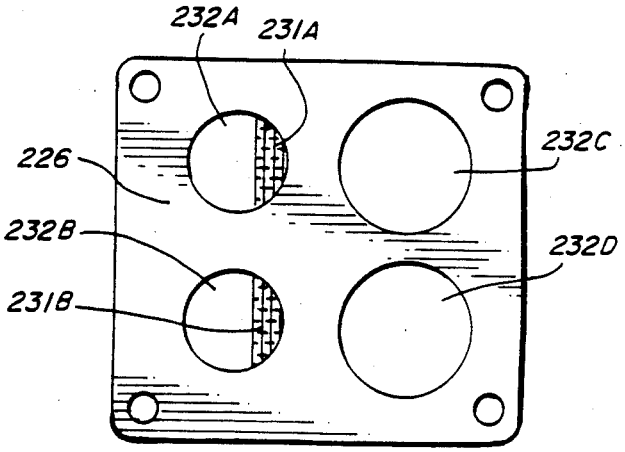
FIG. 11 is a top view of the middle spacer plate of a third preferred embodiment of this invention used with a four-barrel carburetor.
Figure 12:
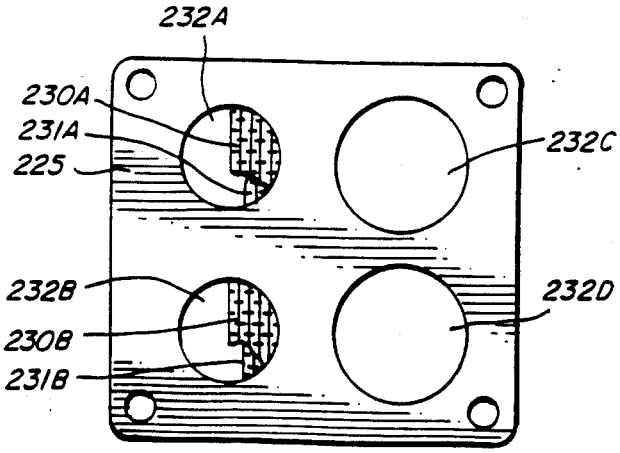
FIG. 12 is a top view of a third preferred embodiment of this invention used with a four-barrel carburetor.

FIGS. 10, 11 and 12 show the best contemplated mode for orienting the two primary passageway screens 230, 231, within the assembly designed for a four-barrel carburetor.

FIG. 10 shows the top primary passageway screens 230A, 230B, are oriented so as to bisect each primary passageway formed by the aligned primary passageway openings 232A, 232B, in each spacer plate 225, 226, 227. Each top primary passageway screen 230A, 230B, covers approximately one-half of the cross-sectional area of each primary passageway formed by the aligned primary passageway openings 232A, 232B, in each spacer plate 225, 226, 227. Additionally, each top primary passageway screen 230A, 230B, is situated directly beneath the back side of the throttle valve in each primary passageway so that it covers the cross-sectional area of the primary passageway formed by the aligned primary passageway openings 232A, 232B, in each spacer plate 225, 226, 227, directly below the back side of throttle valve 213B. The top primary passageway screens for this third embodiment do not necessarily have to be two separate screens but can be a single large screen.

FIG. 10 also shows that no screens are placed in the assembly to cover the two secondary passageways formed by the aligned secondary passageway openings 232C, 232D, in each spacer plate 225, 226, 227.

In FIG. 11, the bottom primary passage screens 231A, 231B, which are below and cover less area than the top primary passageway screens 230A, 230B, are also beneath the back side of the throttle valve in each primary passageway 213B. Each bottom primary passageway screen 231A, 231B, is preferably oriented so as to intersect and cover approximately one-third of the cross-sectional area of each primary passageway formed by the aligned primary passageway openings 232A, 232B, in each spacer plate 225, 226, 227, leaving about two-thirds of the cross-sectional area of each primary passageway unscreened. Again, the bottom primary passageway screens 231A, 231B, for this third embodiment do not necessarily have to be two separate screens but can be a single large screen.

FIG. 11 also shows that no screens are placed in the assembly to cover the two secondary passageways formed by the aligned secondary passageway openings 232C, 232D, in each spacer plate 225, 226, 227.

Additionally, as shown in FIG. 12, it is preferable to orient the screens so that when viewing the primary passageways formed by the aligned primary passageway openings 232A, 232B, in each spacer plate 225, 226, 227, from above the assembly, the mesh of the bottom primary passageway screens 231A, 231B, are offset from the mesh of the top primary passageway screens 230A, 230B. Using 30 holes to the inch screens and orienting the screens in this staggered or offset manner permits approximately one-half of each primary passageway formed by the aligned primary passageway openings 232A, 232B, in each spacer plate 225, 226, 227, the section directly below the front side of the throttle valve in the primary passageway 215B and passing the highest concentration of air, to be free of any screens; approximately one-sixth of the cross-sectional area of each primary passageway formed by the aligned primary passageway openings 232A, 232B in each spacer plate 225, 226, 227, to be covered with 30 holes to the inch screening, the mesh of the top primary passageway screen 230A, 230B; and approximately one-third of the cross-sectional area of each primary passageway formed by the aligned primary passageway openings 232A, 232B, in each spacer plate 225, 226, 227, to be covered with approximately 120 holes to the inch screening, the combined mesh of the separated top primary passageway screen 230A, 230B, and bottom primary passageway screen 231A, 231B. No screens cover the cross-sectional area of the secondary passageways formed by the aligned secondary passageway openings 232C, 232D, in each spacer plate 225, 226, 227. Both secondary passageways are free of any screens.

It is understood that although three preferred embodiments have been disclosed herein, minor variations, changes and modifications may be made therein without departing from the scope and spirit of the invention.

I claim:

1. An improved vaporizing assembly for an internal combustion engine having a carburetor with at least one throttle valve and an intake manifold comprising:

(a) means defining at least one primary passageway between said carburetor and said intake manifold for the flow of fuel and air;

(b) a top screen to vaporize the fuel passing therethrough in each of said primary passageways, said top screen projecting traversely and partially across each of said primary passageways;

(c) means for permitting each said throttle valve to move without obstruction from said top screen;

(d) a bottom screen parallel and beneath said top screen to further vaporize the fuel passing therethrough in each of said primary passageways, said bottom screen projecting traversely and partially across each of said primary passageways;

(e) means for separating said top screen from said bottom screen;

(f) means for separating said bottom screen from said intake manifold;

(g) means for interconnecting the assembly, for preventing unwanted external leakage therefrom and for maintaining a vacuum within the assembly; and (h) means for connecting the assembly to said carburetor and to said intake manifold.

2. The assembly of claim 1 wherein said top screen covers approximately one-half of the cross-sectional area of each of said primary passageways, said bottom screen covers less cross-sectional area of each of said primary passageways than said top screen and both screens are positioned below the back side of said throttle valve.

3. The assembly of claim 2 wherein said bottom screen covers approximately one-third of the cross-sectional area of each of said primary passageways.

4. The assembly of claim 3 wherein said top screen and said bottom screen each has a mesh size of about 30 holes per inch.

5. The assembly in claim 4 wherein said top screen and said bottom screen are stainless steel or tungsten.

6. The assembly of claim 5 wherein the mesh of said top screen is aligned so as to be offset from the mesh of said bottom screen.

7. The assembly of claim 1 wherein said means for permitting said throttle valve to move without obstruction from said top screen is a top spacer plate made of steel.

8. The assembly of claim 7 wherein said means for separating said bottom screen from said intake manifold is a bottom spacer plate made of steel.

9. The assembly of claim 8 wherein said means for separating said top screen from said bottom screen is a middle spacer plate made of steel.

10. The assembly of claim 1 wherein a gasket is positioned between said carburetor and said means for permitting said throttle valve to move without obstruction from said top screen and another gasket is positioned between said intake manifold and said means for separating said bottom screen from said intake manifold.

11. The assembly in claim 10, wherein said gaskets are an asbestos composition.

12. An improved vaporizing assembly for an internal combustion engine comprising:

(a) a steel top spacer plate having at least one primary passageway opening for the flow of air and fuel;

(b) a top screen to vaporize the fuel passing therethrough, said top screen covering approximately one-half the cross-sectional area of each of said primary passageways, and being positioned below the back side of the throttle valve;

(c) a bottom screen parallel and beneath said top screen to further vaporize the fuel passing therethrough, said bottom screen covering less cross-sectional area of each of said primary passageways than said top screen;

(d) a steel middle spacer plate having at least one primary passageway opening for the flow of air and fuel positioned between said top screen and said bottom screen;

(e) a steel bottom spacer plate having at least one primary passageway opening for the flow of air and fuel positioned below said bottom screen;

(f) means for interconnecting said top spacer plate, said top screen, said middle spacer plate, said bottom screen and said bottom spacer plate and for preventing unwanted external leakage therebetween and for maintaining a vacuum within the assembly; and (g) means for connecting the assembly to the carburetor and to the intake manifold.

13. The assembly of claim 12 wherein said bottom screen covers approximately one third the cross-sectional area of each of said primary passageways.

14. The assembly of claim 13 wherein said top screen and said bottom screen each has a mesh size of about 30 holes per inch, are stainless steel or tungsten, and the mesh of said top screen is aligned so as to be offset from the mesh of said bottom screen.

15. An improved vaporizing assembly for an internal combustion engine using a multi-barrel carburetor comprising:

(a) a steel top spacer plate having at least one primary passageway opening for the flow of fuel and air and at least one secondary passageway opening for passing additional fuel and air at high speeds or when additional power is needed;

(b) a stainless steel or tungsten top primary passageway screen to vaporize the flow of fuel, said top primary passageway screen covering approximately one-half the cross sectional area of each of said primary passageways and being positioned below the back side of the throttle valve and having a mesh size of about 30 holes per inch;

(c) a stainless steel or tungsten bottom primary passageway screen beneath said top screen to further vaporize the fuel passing therethrough, said bottom screen covering approximately one third the cross-sectional area of each of said primary passageways, the 30 holes per inch mesh of said bottom primary passageway screen being offset from the mesh of said top primary passageway screen;

(d) a steel middle spacer plate between said top primary passageway screen and said bottom primary passageway screen and having at least one primary passageway opening for the flow of air and fuel and at least one secondary passageway opening for passing additional fuel and air when the engine operates at high speeds or when additional power is needed;

(e) a steel bottom spacer plate below said bottom primary passageway screen and having at least one primary passageway opening for the flow of air and fuel and at least one secondary passageway opening for passing additional fuel and air when the engine operates at high speeds or when additional power is needed;

(f) means for interconnecting said steel top spacer plate, said top primary passageway screen, said steel middle spacer plate, said bottom primary passageway screen and said steel bottom spacer plate and for preventing unwanted external leakage therebetween and for maintaining a vacuum within the assembly; and (g) means for connecting the assembly to the carburetor and to the intake manifold.

* * * * *